US006220958B1

(12) United States Patent
Jones et al.

(10) Patent No.: US 6,220,958 B1
(45) Date of Patent: Apr. 24, 2001

(54) SUPPORT BRIDGES FOR AIR DIFFUSERS INCLUDING SPRING LOADING FOR AIR FLOW CONTROL BLADES

(75) Inventors: Gordon G. Jones; Gerald Cook, both of Tuscon, AZ (US)

(73) Assignee: Air System Components LP, Dayton, OH (US)

( * ) Notice: Subject to any disclaimer, the term of this patent is extended or adjusted under 35 U.S.C. 154(b) by 0 days.

(21) Appl. No.: 09/484,763

(22) Filed: Jan. 18, 2000

(51) Int. Cl.[7] ..... F24F 13/072
(52) U.S. Cl. ..... 454/303
(58) Field of Search ..... 454/292, 301, 454/303, 304

(56) References Cited

U.S. PATENT DOCUMENTS

| | | | |
|---|---|---|---|
| 2,221,001 | 11/1940 | Lucius . | |
| 3,177,795 | 4/1965 | Schutt . | |
| 3,177,796 | 4/1965 | Lee et al. . | |
| 3,266,408 | 8/1966 | Palmquist . | |
| 3,276,348 | 10/1966 | Kennedy . | |
| 3,319,559 | 5/1967 | Raider et al. . | |
| 3,406,623 | 10/1968 | Lambert . | |
| 3,601,033 | 8/1971 | Lambert . | |
| 3,760,709 | 9/1973 | Rachlin et al. . | |
| 3,811,369 | 5/1974 | Ruegg . | |
| 3,828,508 | 8/1974 | Moeller . | |
| 3,848,799 | 11/1974 | Day . | |
| 4,316,407 | 2/1982 | Lambert . | |
| 4,491,062 | 1/1985 | Sylvester et al. . | |
| 4,811,575 | 3/1989 | Currier et al. . | |
| 4,815,362 | 3/1989 | Ishizuka et al. . | |
| 4,851,066 | 7/1989 | Currier et al. . | |
| 4,869,157 | 9/1989 | Hungerford | 454/303 |
| 5,001,967 | 3/1991 | Hungerford . | |
| 5,107,687 | 4/1992 | Candeloro . | |
| 5,107,755 | 4/1992 | Leban et al. . | |
| 5,215,284 | 6/1993 | Hungerford . | |
| 5,219,312 | 6/1993 | Smith . | |
| 5,433,662 | 7/1995 | Hungerford . | |
| 5,447,471 | 9/1995 | McDermott . | |
| 5,462,484 | 10/1995 | Jung et al. . | |
| 5,788,572 | 8/1998 | Felsen | 454/303 |
| 5,871,334 | 2/1999 | Suzuki et al. . | |

*Primary Examiner*—Harold Joyce
(74) *Attorney, Agent, or Firm*—Shughart Thomson & Kilroy P.C.

(57) ABSTRACT

A slot diffuser includes a pair of elongate and parallel side walls spaced by pairs of bridges. The bridges include feet that slide along receivers in the side walls such that the bridges can be positioned at any location therealong and provide support to the bridges and stability to the diffuser. The bridges include slots that extend between the side rails and that receive ends of air flow control blades. The air flow control blades include an elongate planar portion supported by slot following pegs extending outwardly on either side of the planar portions to support the blades in the slots. The bridges include a spring mechanism to provide bias to the blades to prevent wedging and rattling. The bridges also include a top arcuate cover that reduces air drag and noise.

12 Claims, 3 Drawing Sheets

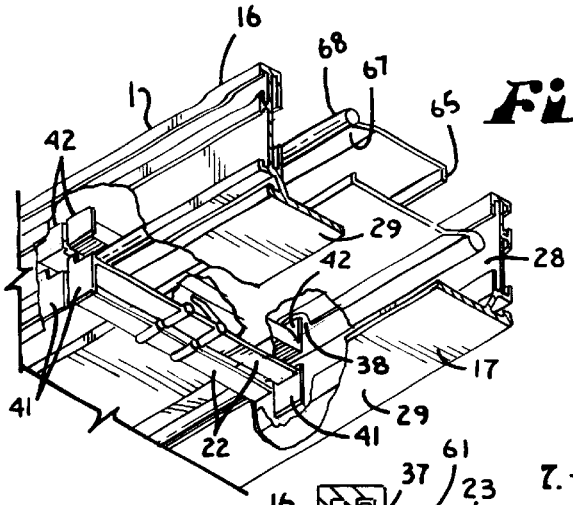
Fig.2.
Fig.3.
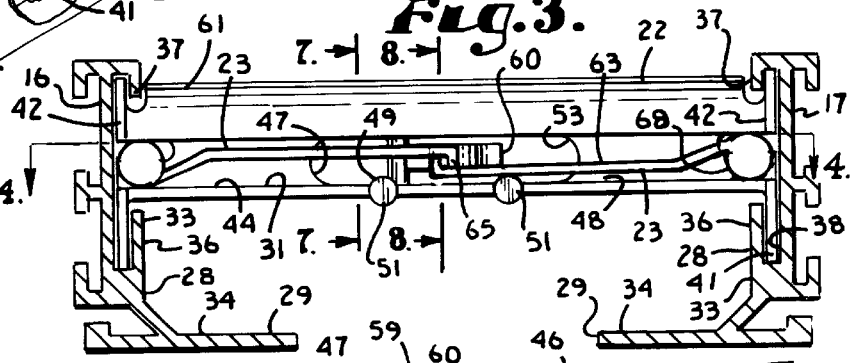
Fig.4.
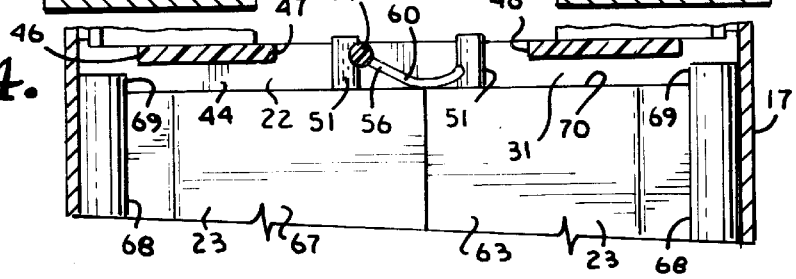
Fig.5.
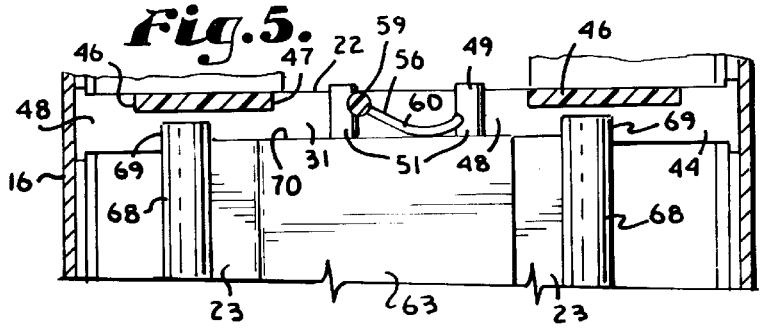

SUPPORT BRIDGES FOR AIR DIFFUSERS INCLUDING SPRING LOADING FOR AIR FLOW CONTROL BLADES

BACKGROUND OF THE INVENTION

The present invention is directed to slot diffusers or air bars that control air flow from a ventilation plenum into a room and, in particular, to improvements in bridges which support air control blades within the diffusers.

Air diffusers are used in many different architectural environments for controlling the flow of air form heating and cooling ventilation systems into a room. Because of requirements associated with the geometry of a particular room and because of uneven heating or cooling requirements caused by sunlight or other heating or cooling loads in specific locations, it is often desirable to direct the air flow from the delivery plenum in a particular configuration to best suit the needs of the room.

In some instances it is best to have the air flow be a jet-type flow which comes straight out into the room. In other instances the air flow will be more diffuse and/or dampened. And in still other situations it may be desirable to direct air flow to one side or to the other side of the diffuser so that the air travels along a ceiling or wall adjacent to the diffuser.

Prior art diffusers have included various air flow controlling surfaces for distribution of the air exiting therefrom. For example, the Hungerford patent U.S. Pat. No. 5,001,967 illustrates a diffuser having air control blades that are adjustable by rotation within the diffuser and act in conjunction with body surfaces of the diffuser in an attempt to control the flow of the air from the diffuser.

Where distribution of air flow to the side is desired or where dampened air flow is desired, air flow is usually diverted in some manner within the diffuser so that it does not pass straight through the diffuser. In the present invention, a pair of air control blades work in cooperation with each other and with other surfaces of the diffuser to control air flow. The air flow control blades are positioned to be generally perpendicular to the air flow passing through the diffuser. The blades are supported by bridges within the diffuser and are preferably slidable along the bridges so that the blades can be moved relative to each other in order to control the amount of overlap of one blade over the other which in turn controls the flow of air through the diffuser. The blades are also movable with respect to the bridges and, in particular the blades can also be moved toward one side or the other of the diffuser to operably control the directional output of the air from the diffuser.

One problem encountered with movement of blades in this manner is that the blades tend to cock or turn slightly out of alignment with slots receiving the blades such that the blade either incurs sufficient drag to become very hard to move or becomes fully wedged and immobilized. It is also desirable to have a constant slight bias against the blades to hold them in position and to reduce the likelihood that the blades will rattle.

Consequently, it is desirable to provide a system for supporting the air control blades in such a manner as to prevent wedging of the blades so as to allow the blades to move smoothly and easily relative to the diffuser and each other, while also holding the blades in place and reducing rattling. In this manner a technician can properly adjust the blades during installation or to modify the position of the blades at a later time.

SUMMARY OF THE INVENTION

An air diffuser is provided that operates in conjunction with an air delivery plenum to supply heating and ventilation air to a room under directional and volume control of the diffuser. The diffuser includes a pair of slide rails joined by end plates in such a manner as to be operably mountable within a ceiling or a wall surface and to be flow joined with an air delivery plenum. The diffuser also includes at least one pair of bridges which are positioned opposed to each other and a set of air flow control blades which are mounted in and extend between the bridges. The bridges each include a slot for receiving an end of each blade such that the blades may move laterally from side to side within the slot and such that the blades are preferably in overlapping relationship with one another in at least some configurations of the diffuser.

The blades are generally parallel to one another and are slidable relative to each other, as well as the bridges so as to be selectively positionable within the diffuser. In this manner the blades may as a pair be positioned anywhere between being fully to one side of the diffuser or fully to the opposite side of the diffuser. Furthermore, the overlap of the blades may be varied to allow more or less spreading therebetween. That is, as the blades slide relative to each other to a more separated position, the space obstructed by the blades increases, thereby producing a greater obstruction to air, and in this way air flow is dampened. For increased flow the blades are positioned for greater overlap. Moving the blades from side to side changes the directional output of the air from the diffuser. Thus, the blade design allows for a wide variety of directional air flows, as well as volumes of air flow through the diffuser.

Each of the bridges includes a spring arm that is located within the slot that receives the blades and which engages both of the blades. The spring arm provides a constant bias to the blades that maintains the blades in spaced relationship with respect to a rear wall of each slot, so as to reduce the likelihood that a blade will become wedged against the wall. This allows free movement of the blades within the slot for purposes of adjustment. Furthermore, the spring arm provides a constant small amount of bias to each of the blades so as to prevent the blades from rattling within the diffuser as air passes the blades.

The bridges have feet at each end that are slidably mounted in receivers in the side rails to allow movement of the bridges along the side rails, but yet provide support to the bridges.

Each bridge also includes an arcuate cover that slopes from rear to front, preferably with a radius equal to the thickness of the bridge, so as to reduce air turbulence.

OBJECTS AND ADVANTAGES OF THE INVENTION

Therefore, the principle objects of the present invention are: to provide an air diffuser that has air control blades which are adjustable within the diffuser to modify both the directional flow of the air and the volume of the air exiting the diffuser; to provide such a diffuser wherein the blades are supported in an overlapping relationship by opposed bridges within the diffuser and wherein the blades slide relative to each other and to the bridges to allow a technician to position the blades for a desired air volume flow, as well as to adjust directional flow of the air before or after installation; to provide such a diffuser wherein the bridges are self supporting and are easily slidably mounted within side rails of the diffuser to provide support to the blades; to provide such a diffuser wherein the blades are easily removable after installation; to provide such a diffuser wherein the blades are mounted in slots in the bridges and the bridges include a spring arm located in the rear of each slot that continuously biases against the blades during use and prevents the blades from becoming cocked or wedged within the bridges and also which reduces vibration and noise associated with the blades as air passes past the blades; to provide such a diffuser that allows easy adjustment of the blades once the diffuser is fully installed, including removal of the blades, if necessary; to provide such a diffuser which includes comparatively few parts, is easy to assemble and highly stable in use; and to provide such a diffuser which is a relatively easy to manufacture, inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 2 is a fragmentary perspective view from below the air diffuser, showing side rails, the bridges and a pair of blades, with portions broken away to show internal detail thereof.

FIG. 3 is a cross-sectional view of the air diffuser, taken along line 3—3 of FIG. 1.

FIG. 4 is a cross-sectional view of the air diffuser, taken along line 4—4 of FIG. 3, illustrating interaction of the blades with a spring arm and with the blades positioned to be fully spread and blocking flow of air through the diffuser.

FIG. 5 is a cross-sectional view of the air diffuser, taken along the same line as FIG. 4, illustrating the interaction of the blades with the spring arm and with the blades fully overlapping so as to maximize air flow through the diffuser.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
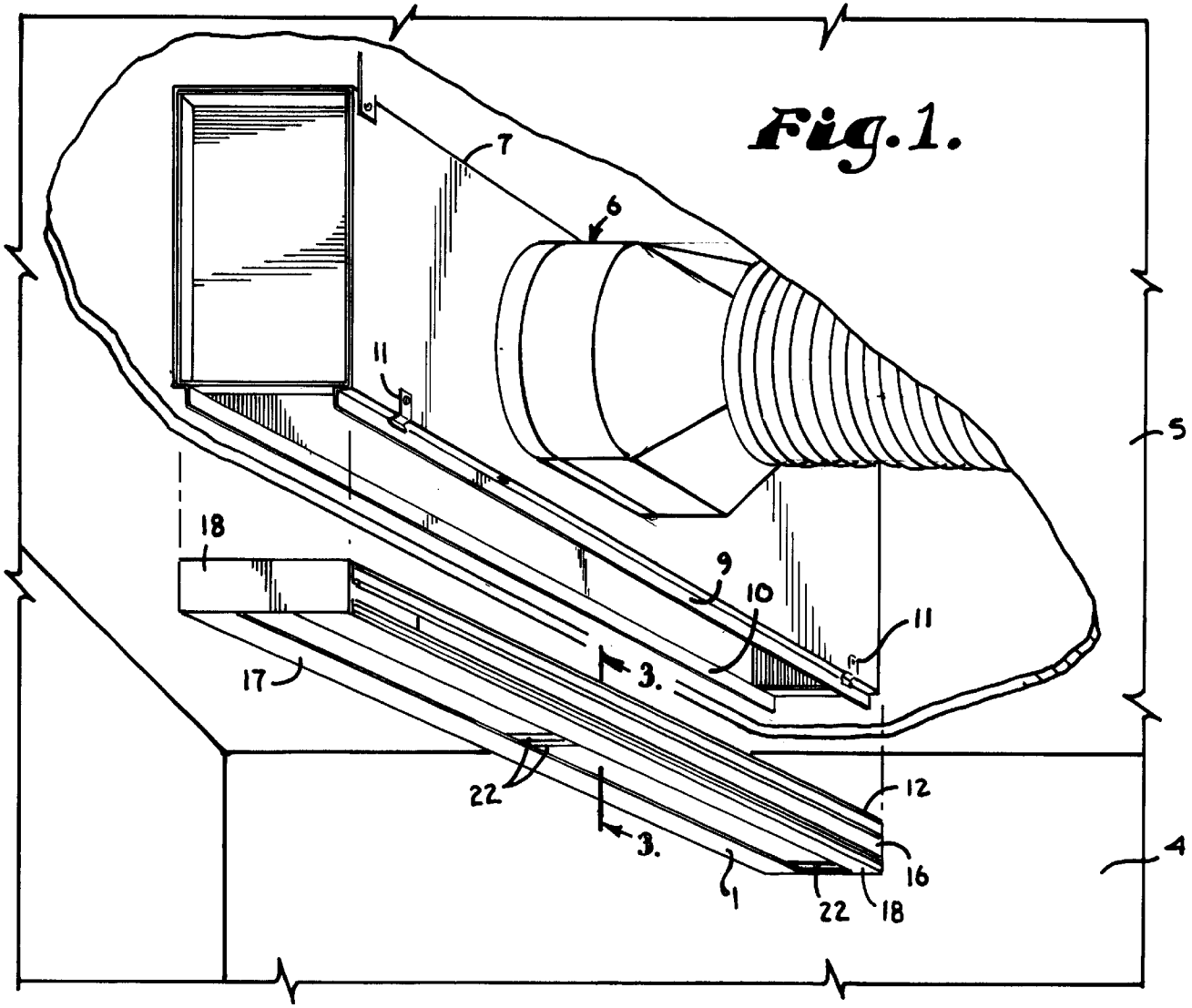
FIG. 1 is a perspective view of a ceiling with a diffuser having blade supporting bridges in accordance with the present invention, shown spaced from an air delivery plenum in the ceiling just prior to final assembly, with portions of the ceiling broken away to show detail thereof.

The reference in numeral 1 generally designates an air bar or slot air diffuser in accordance with the present invention. The diffuser 1 is shown in FIG. 1 just prior to final installation in a room 4. The room 4 has a ceiling 5 with an air distribution plenum 6 located above the ceiling 5 opening into a boot 7. The boot 7 has flanges 9 and 10 that mate with the diffuser 1 and a plurality of snaps or fasteners 11 which secure the diffuser 1 to the plenum 6 and, in particular, to the boot 7. In this manner air being distributed by the plenum 6 is supplied to the top or plenum facing side 12 of the diffuser 1. As used herein the terms top and bottom refer tot he diffuser 1 as seen in FIG. 3; however, it is foreseen that the diffuser 1 of the present invention may be used in a variety of orientations, such as in ceilings, walls or the like and the terms refer to direction within the diffuser 1 and not room direction.

Figures 6, 7, 8:
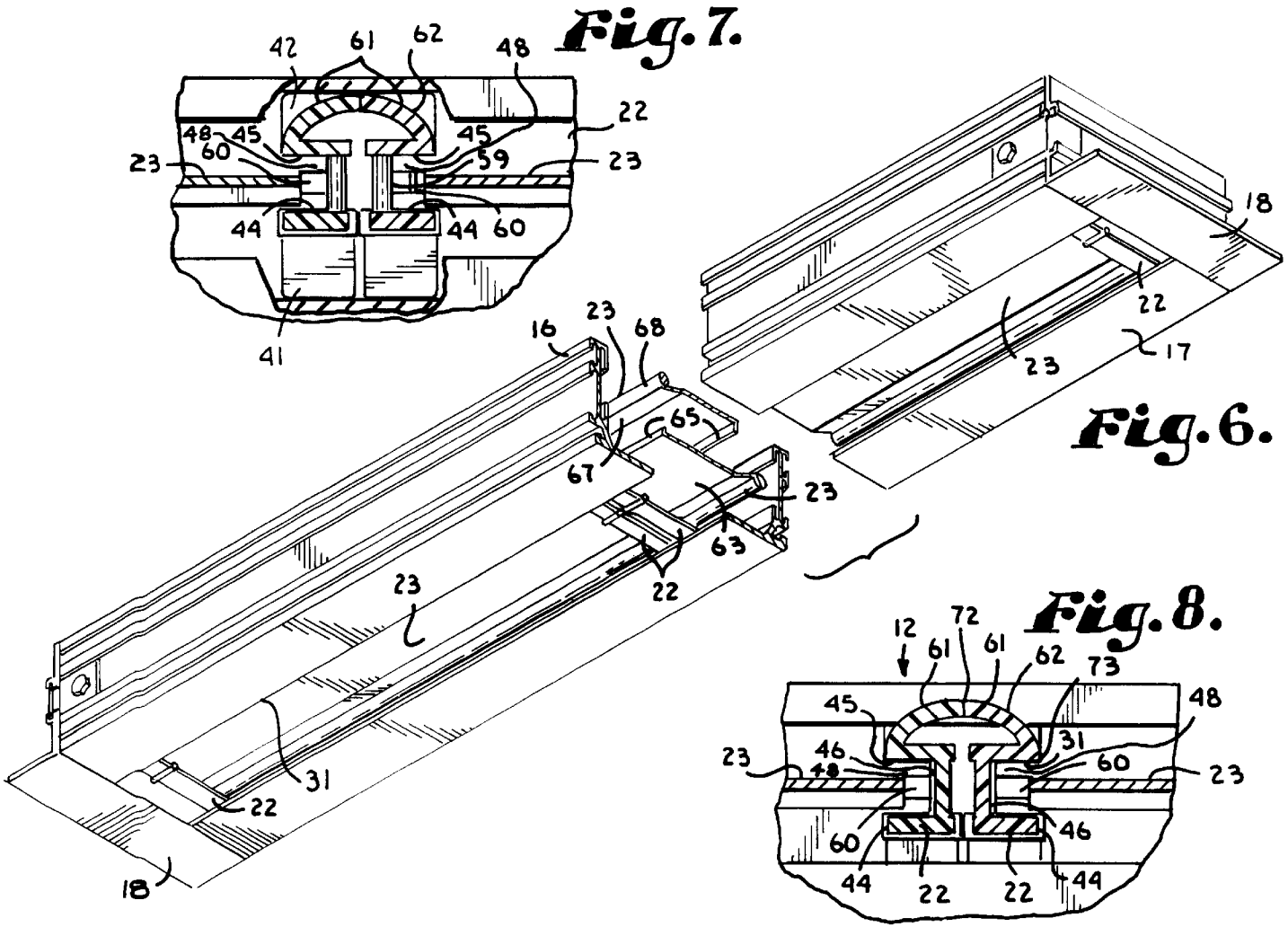
FIG. 6 is an enlarged and fragmentary perspective view of the air diffuser from below with portions broken away to show detail.
FIG. 7 is an enlarged and fragmentary cross sectional view of a bridge of the air diffuser, taken along line 7—7 of FIG. 3.
FIG. 8 is an enlarged and fragmentary cross sectional view of a bridge of the diffuser, taken along line 8—8 of FIG. 3.

The diffuser 1 includes a pair of side frame rails 16 and 17 joined at opposite ends by end plates 18. The diffuser 1 also includes two pairs of bridges 22 and two pairs of air pattern controller blades 23 (FIG. 6). In particular, the illustrated diffuser 1 has two sets of blades 23 which may be the same or different depending on the needed air distribution. It is foreseen that diffusers 1 may have only one set of blades 23 or multiple adjacent sets of blades, aligned end to end, as needed.

The frame rails 16 and 17 are generally elongate, and each have a sidewall 28 and a bottom flange 29 that extends outwardly from the lower or outer most edge of each side wall 28 in facing relationship to the flange 29 of the opposite side rail, but spaced so as to form a slot 31 therebetween. Each side wall 28 has an interior surface 33 (FIG. 3), such that the surfaces 33 of opposed side walls 28 face each other. Likewise each bottom flange 29 has an inward facing or interior surface 34 that is generally perpendicular to the flow of air through the diffuser 1.

The surfaces 33 and 34 cooperate with the blades 23 to control the directional flow of air through the diffuser 1. Each side wall 28 also includes upper and lower flanges 36 and 37 that cooperate to form a receiver 38 within which a respective side of each of the bridges 22 is received in such a manner as to allow the bridges 22 to be slidably positioned along the rails 16 and 17.

Each of the bridges 22 is sized and shaped to span between a pair of opposed side rails 16 and 17. Each of the bridges 22 has a pair of feet 41 and 42 (FIG. 2) that extend in opposite directions and are sized and shaped to be slidably received in the receivers 38. The bridges 22 are thus supported by the side rails 16 and 17, but are slidable in the receivers 38 during assembly and during certain modifications of the diffuser 1.

Each bridge 22 has a lower wall 44 and an upper wall 45 (FIGS. 7 and 8) that extend between the feet 41 and 42, are parallel to one another and are spaced by a rear wall 46. For each bridge 22 the lower wall 44, upper wall 45 and rear wall 46 form a blade receiving slot 48 (FIG. 8) that operably slidably receives the blades 23. The rear wall 46 has a central aperture 47 (FIG. 6) located therein. Each of the slot lower walls 44 include a pair of spaced rests 51 that are cylindrical in shape and protrude upwardly from the surface of the lower wall 44 to expose a semi-circular surface 49. The rests 51 are aligned parallel to the frame rails 16 and 17 and are spaced from each other. The rear wall aperture 47 includes a portion 53 that is located just laterally with respect to the rests 51.

Mounted in each of the slots 48 between the rests 51 is a spring arm or member 56. Each spring member 56 includes a mounting post 59 that extends between the lower wall 44 and upper wall 45 in close proximity to the rear wall 46 and a spring 60. Each spring 60 is elongate and curves so as to be arcuate and so as to be bowed outwardly from the rear wall 46. Each spring 60 is positioned to engage the blades 23 associated therewith, as will be discussed below.

Each bridge 22 has a cover 61 that includes a curved or arcuate top surface 62 that is rounded with a radius that is approximately equal to the thickness of the bridge 22 and that allows smooth transition with the slot upper wall 45 from a rear 72 to a front 73 thereof. The rounded feature of the surface 61 reduces drag of air across the bridge 22 and thus reduces noise created by air passing the associated bridge 22, as this air is less turbulent. Each of the blades 23 includes a generally planar and elongate portion 63 joined along an edge thereof to a rectangular shaped lip or rod 65 that is slightly larger than the planar portion 63 and at an opposite end to a ramp 67 and a second round rod 68 that is comparatively larger in diameter than the thickness of the planar portion 63.

The rod 68 is approximately the same size as the slot 48 so as to be received completely therein in such a manner as to allow the blades 23 to slide within the slots 48. The rods 68 are slightly longer than the remaining parts of each blade 28, including the planar portion 63, ramp 67 and rod 65. In this manner the rods 63 have pegs or posts 69 that are slot followers and are received further into the slot 48 then the remaining portions of the blade 23 including planar portion 63. As is seen in FIGS. 3 through 5, the planar portions 63 of the blades 23 have ends 70 that are supported on the rests 51 and abut against a respective spring 60.

In use the bridges 22 receive and support the blades 23 in such a manner as to apply a constant axial bias to maintain the blades 23 in proper position and reduce noise; however, the bias may be simply overcome by a technician to allow removal and replacement of the blades without total disassembly of the diffuser 1 or surrounding room structure.

It is to be understood that while certain forms of the present invention have been illustrated and described herein, it is not to be limited to the specific forms or arrangement of parts described and shown.

What is claimed and desired to be secured by Letters Patent is as follows:

1. A slot diffuser for distributing air flow to a room comprising:

a) a pair of spaced frame side rails; a pair of spaced bridges joining said side rails; each of said bridges including a slot having associated therewith a rear wall; each of said bridges also including a spring member positioned within a respective slot; and b) an air flow control blade mounted at opposite ends in respective slots of said bridges; said blade ends operably being biased away from said slot rear walls by said spring members, so as to allow said blade to slide in said slots due to pressure without wedging and so as to limit movement of said blade within said slot due to air movement.

2. The diffuser according to claim 1 wherein:

a) said blade is a first blade; and including b) a second blade partially overlapping said first blade and slidably mounted at opposite ends in respective slots.

3. The diffuser according to claim 2 wherein:

a) said slots are sized and shaped such that said first and second blades are slidable between opposite ends of said bridges as a pair in order to control direction of air flow through said diffuser and said blades are slidably with respect to each other to produce different obstruction surfaces of different sizes within said diffuser so as to control volume of air through said diffuser.

4. The diffuser according to claim 3 wherein:

a) said blades are aligned generally perpendicular to incoming flow of air through said diffuser.

5. The diffuser according to claim 1 wherein:

a) each of said side rails includes an inner wall surface and a bottom inward extending flange having an air engaging top surface; each of said rail inner wall surfaces and said flange top surfaces cooperating with said blade to control direction of air flow from said diffuser.

6. The diffuser according to claim 1 wherein:

a) each of said spring members includes a mounting post extending between top and bottom walls of each associated slot and each of said posts are mounted near the rear wall of each respective slot.

7. The diffuser according to claim 6 wherein:

a) each said spring member includes an arcuate spring extending from a respective mounting post.

8. The diffuser according to claim 1 wherein:

a) each of said side rails including a pair of facing flanges forming an inwardly facing receiver; and b) each of said bridges include feet on opposite ends thereof slidably positioned in respective side rail receivers; such that said bridges are supported by and slidable along said side rails.

9. The diffuser according to claim 1 wherein:

a) each of said bridge slots has a blade receiving lower wall operably supporting said blade.

10. The diffuser according to claim 1 wherein:

a) each of said bridge lower walls includes a semi-circular rest for operably spacing a portion of said blade from a remainder of said lower wall to reduce friction therebetween.

11. The diffuser according to claim 1 wherein:

a) said blade includes a generally planar portion with a rod near one side thereof extending the length of said blade; said rod being thicker in diameter than said planar portion and extending beyond said planar portion on each end so as to form pegs that are slidably received in respective slots.

12. The diffuser according to claim 11 wherein:

a) each of said blade planar portions are joined to a respective rod by a ramp portion that positions said planar portion outwardly as opposed to centrally with respect to a respective rod.

* * * * *